US005127961A

United States Patent [19]

Aiton

[11] Patent Number: 5,127,961

[45] Date of Patent: Jul. 7, 1992

[54] METHOD AND APPARATUS FOR FORMING A FROTHED FLUID SLUG FOR PIPE CLEANING

[75] Inventor: Gerald R. Aiton, Seabrook, Tex.

[73] Assignee: Naylor Industrial Services, Inc., Houston, Tex.

[21] Appl. No.: 628,166

[22] Filed: Dec. 14, 1990

[51] Int. Cl.[5] ..... B08B 9/02

[52] U.S. Cl. ..... 134/22.12; 134/34; 134/36; 134/98; 134/102; 134/113; 134/169 C

[58] Field of Search ..... 134/22.12, 22.11, 22.13, 134/22.14, 34, 36, 37, 98, 102, 113, 169 C

[56] References Cited

U.S. PATENT DOCUMENTS 2,771,891 11/1956 Palley ..... 134/169 C
2,771,892 11/1956 Palley ..... 134/113 X
2,818,076 12/1957 Erling ..... 134/102
3,094,998 6/1963 Gley ..... 134/113 X

FOREIGN PATENT DOCUMENTS 666458 7/1963 Austria ..... 134/22.12

*Primary Examiner*—Theodore Morris
*Assistant Examiner*—Saeed Chaudhry
*Attorney, Agent, or Firm*—Gunn, Lee & Miller

[57] ABSTRACT

A method and apparatus for forming a low density slug flush for pipe cleaning is set forth. The device includes a container with standpipe which are connected together in the form of a U-tube. A specified liquid volume is held in this. There is a head space in the container at the upper end. The liquid is removed from the container through a bottom located liquid flow line and a top or head connected gas flow line also extends to the line to be cleaned. Remotely, a driving gas is accumulated under pressure and is delivered into the container to force liquid from the container and to also flow through the gas flow line for co-mingling in the line, thereby forming a low density foam which is forced by the continued introduction of gas into the container so that the slug flush travels the full length of the line without jarring the equipment.

13 Claims, 1 Drawing Sheet

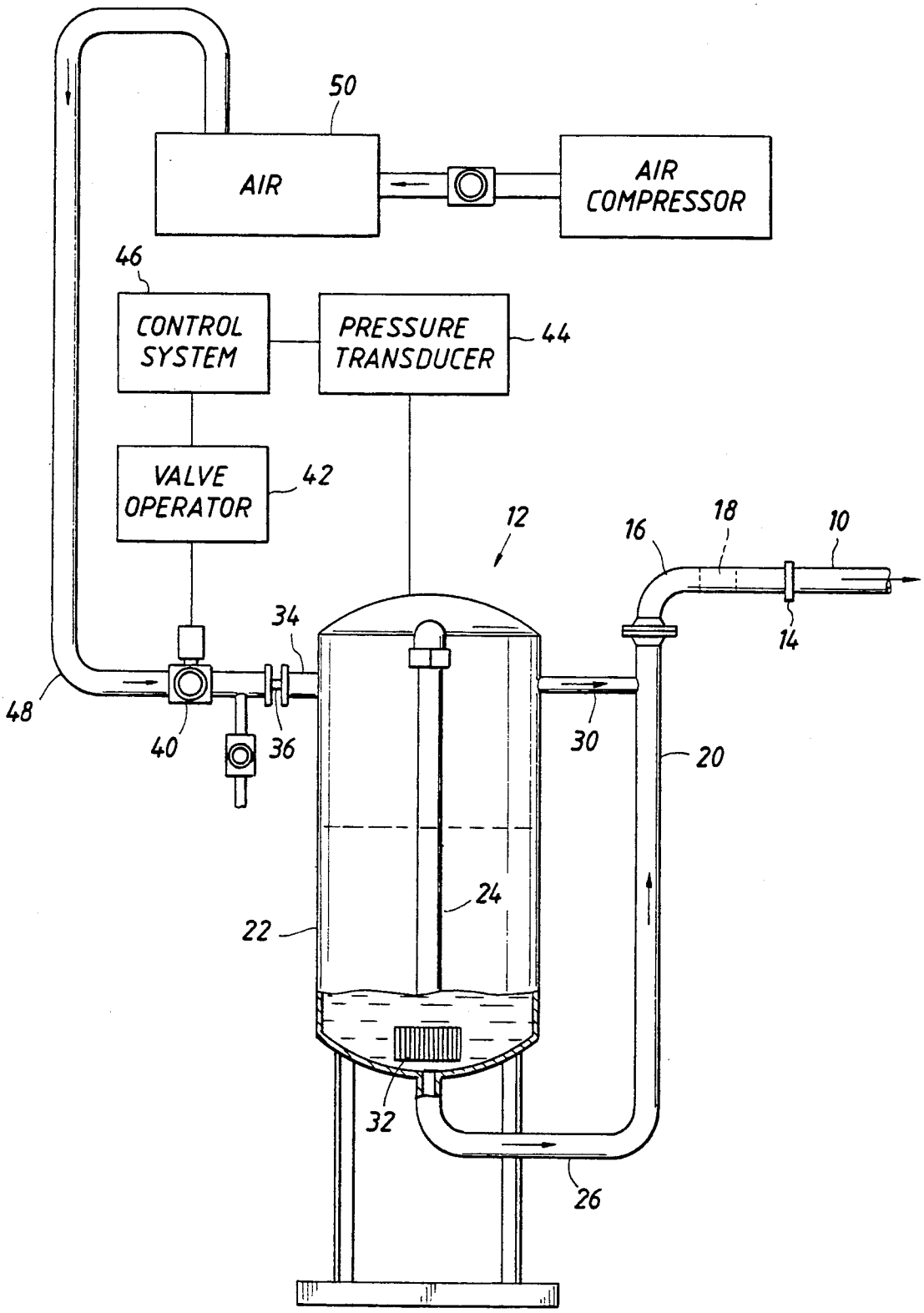
50
AIR
AIR COMPRESSOR
46
CONTROL SYSTEM
PRESSURE TRANSDUCER
44
VALVE OPERATOR
42
12
16
18
10
14
34
48
40
36
30
20
24
22
32
26

METHOD AND APPARATUS FOR FORMING A FROTHED FLUID SLUG FOR PIPE CLEANING

BACKGROUND OF THE DISCLOSURE

This disclosure is directed to a method and apparatus for forming a slug flush and, in particular, a slug flush which has a requisite low density. This is accomplished by foaming a cleaning liquid with air, or some other gas, so that the density of the liquid slug is reduced to accomplish cleaning without destruction which might otherwise occur. More specifically, it is directed to a method for forming a slug of frothed water or other liquid which can be forced through a pipe at high speed for cleaning purposes. It is necessary to periodically clean pipes in refineries, petrochemical processing plants, and the like. It is also necessary to clean such pipes at the time of construction. During the midst of construction, trash and debris accumulates in the pipes. This accumulation of trash arises from several sources. For instance, construction trash will be left in the pipe. In addition to that, the pipe is normally assembled by welding joints and fittings together. This creates welding slag and other construction debris. Often, the pipe is stored in the open before it is assembled in the pipe. In the open, it may accumulate loose dirt, trash, or dried mud on the interior. In addition, small animals will often be caught in the stored pipe or other fittings and may die, leaving a skeleton in the pipe. There are other sources of construction trash and debris which regrettably accumulate, and therefore all of the trash must be removed before the assembled pipe is placed into service. This is true of short as well as long pipes in a petrochemical plant or the like. That is, the pipes are traps for trash which must be cleared before the pipe can be placed in service.

By contrast, a pipe that has been in service for a long period of time may begin with a clean internal wall, but the product which flows through the pipe may form a coating or film on the interior of the pipe. This occurs with the flow of water where any hard minerals in the water adhere to the wall of the pipe and can build up a coating on the interior which can ultimately plug the pipe. Other types of coatings can build up on the interior of the pipe when the product flowing through the pipe is one which is subject to drying or curing. A coating of heavy molecules will coat the pipe line. This is especially true where petroleum products having a wide range of molecular weights flow through the pipe. Sometimes, the heavier greases or sludges will collect and form a film.

Whether it is an original construction problem or a coating that builds up during use, the pipe must be periodically cleaned. One cleaning approach is to force a slug of cleaning fluid through the pipe. The most common process is to force water through the pipe for cleaning. It is not uncommon to position a small nozzle with connected fire hose in a pipe and force it further and further into the line. The jetting action of the water exhausted from the fire hose will, at least to some measure, provide cleaning. This however is considered inadequate for most needs. It has also been common practice to force water through a pipe by delivering water into that line from some kind of storage container. In some instances, the water may be pure and in other instances, the water may have specifically selected additives such as degreasing agents and the like. Typically, that involves the addition of some kind of appropriately selected solvent with the water. In any case, multiple procedures have been implemented in the past to deliver such slugs of fluid through the pipe.

The cleaning process that is contemplated herein is sensitive to the velocity of the flowing slug of cleaning fluid. In the instance of use of a fire hose with a nozzle, cleaning velocities of just a few feet per second can be achieved. These velocities however are significantly inadequate. Other jury rigged procedures can be used which might obtained higher velocities. However, these have their own problems because velocities normally are not high enough. In the event that the velocities are higher, they run the risk of delivering an uncontrolled fluid flush which will damage the pipe and the supporting equipment. For instance, a fire hose might deliver water at about 4 to 8 feet per second. It is possible with connected tanks, with substantially pressure to achieve velocities of 10 or more feet per second. However, and particularly in the case of a larger diameter line (e.g., 6 inches, 16 inches, etc.), the velocity of the slug and the length of the slug become intertwined so that the mechanical dynamics of supporting the pipe become very difficult to handle. A liquid slug of any density whatsoever will create reaction forces as it travels the line. These reaction forces resemble the water hammer which can damage plumbing in residential buildings should the shock wave of the water hammer become excessive. In similar fashion, slug flushing of pipe with a high density liquid creates a risk of damage to the pipe as a result of the reaction forces. The present method and apparatus set forth a system whereby a slug of water or other high density liquid can be delivered; even though high velocities may be achieved for quality cleaning, the density of the slug is reduced and the velocity is controlled so that detrimental mechanical impact forces are avoided in the pipe cleaned by the travelling slug flush. Densities are reduced to perhaps 10 to 25%; most of the slug is air.

One advantage of the present apparatus and method of use is that slug flush cleaning can then be used where the process would otherwise run the risk of creating detrimental water hammer. In particular, a slug of substantial length and velocity is delivered into the pipe. It is however frothed to reduce the density so that the kinetic energy of the travelling slug is not so great that it will damage the pipe when an elbow, tee, or other bend is encountered in the pipe. Consider as an example a slug which is introduced into a pipe having a nominal internal diameter of 12 inches and a length of 1000 feet. Assume further that the velocity of the slug is about 50 1 feet per second. This high velocity slug is sufficiently fast for a very good cleaning of on the pipe. The slug will clean practically every type of trash accumulated during construction. Should it be a pipe that has been in serve for some time, the slug will also break up the surface coating and provide a substantial scrubbing to the inside wall of the pipe. In any case, if such a slug were water substantially without bubbles, the froth slug would have substantial kinetic energy. A rough approximation of that kinetic energy for a slug 20 diameters in length in a 12" pipe or 20 cubic feet of water, travelling at 50 feet per second, would deliver sufficient kinetic energy at an elbow in the line that the line would likely be jarred free of structural supports near the elbow; this would damage the line tremendously. If however the density were reduced by 70 to 90 percent, the kinetic energy in the travelling slug would be reduced to levels which may be safely handled by the supports for the line to avoid destruction of the line. In light of this example, the present invention sets forth a method and apparatus enabling delivery of a frothed slug which cleans the line adequately without creating so much kinetic energy in the travelling slug that damage to the line might result. This involves filling a storage tank having a predetermined capacity with air or other driving gas to be delivered behind the slug to propel the slug through the line. It also involves storage of a sufficient amount of liquid in a tank. The preferred liquid for most applications is water, although other liquid solvents can be used. The water is stored in a small tank for delivery into the line to be cleaned. A valve is cracked open at a rate to force the slug of liquid into the line. Delivery of liquid into the line is accomplished simultaneously with delivery of compressed gas into the line; relative diameters of the gas line and the liquid delivery line control the ratio of mixing and to form the froth slug. Gas under pressure is continuously delivered behind the slug to complete the cleaning process.

The apparatus of the present disclosure utilizes a liquid storage tank having two outlet lines. One is from the bottom so that liquid in the tank is delivered through the bottom outlet into the line to be cleaned. Another outlet connects to the top of the tank so that the driving gas is also delivered. These two outlets are relatively sized in accordance with a predetermined ratio so that mixing the liquid and driving gas is assured. A controllable valve connected to a storage tank of predetermined size is switched ratably to deliver the driving gas into the line to force the slug along the line for cleaning purposes. The flow of gas into the storage tank is limited so that pressure peaks or spikes are avoided.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

The single drawing with the present disclosure shows a liquid storage tank having head space therein for driving gas accumulation wherein both the liquid and gas are delivered through separate outlets into the line to be cleaned, and cleaning is initiated by the controlled opening of a valve from a gas storage tank thereby initiating slug formation in the line to be cleaned.

DETAIL DESCRIPTION OF THE PREFERRED EMBODIMENT

Attention is first directed to the only drawing where the line 10 is shown connected to the equipment of the present disclosure. This equipment is identified generally by the numeral 12. The equipment 12 is temporarily connected with the line 10 for cleaning. The line 10 is a pipe having some defined length and diameter and is located typically in a petrochemical plant. The line 10 is cleaned prior to placing in service and after long periods of service. The line 10 is normally permanent equipment while the apparatus 12 is temporarily connected for cleaning and is thereafter disconnected and removed. The line 10 may have one or more right angle bends typically at elbows, tees, and the like. The line 10 is normally supported by pipe hangers and the like. It is not uncommon for the line 10 to be routed up along distillation columns, or perhaps connect with a storage tank. The line 10 may also connect with several smaller lateral lines or ultimately terminate at a header. In any case, the line 10 is situated in its ordinary setting supported by pipe hangers and the like which hold it in position. Pipe hangers, braces, and other supports holding the line 10 are likely broken should excessive shock forces be applied to the line in the fashion of a water hammer. It is highly undesirable to create excessive shock forces on the line because it may cause sufficient damage that the line 10 has to be shut down for repairs. This may cause shut down of the entire plant and process.

For purposes of description, assume that the line 10 is any typical line size from about one inch to twelve inches, and the length is any suitable length appropriate for a petrochemical plant. This process is needed for plant piping systems and is not normally used for cross country pipelines, e.g., 50 mile pipelines. Indeed, it can have a length up of several thousand feet. Assume further that it has trash and debris in it which ought to be cleaned. The present invention is equally suitable for cleaning at the post construction stage where the line has never been in service, or is equally useful in cleaning the line after coatings such as varnishes and the like have formed on the interior of the line.

The present apparatus 12 connects to the line 10 by means of a suitable flange connection 14. There is an elbow 16 which is provided with internal flow straighteners 18. The elbow 16 connects with a standpipe 20. The standpipe 20 connects to the bottom of a tank 22 of specified volume. The tank 22 is provided with an externally located sight glass 24 which enables an observer to see the level of liquid and therefore obtain information indicating the amount of liquid in the tank. The standpipe 20 connects through a bend 26 to the lower end of the tank 22. This bend has a specified diameter and serves as the liquid outlet. The cross sectional area of the bend and pipe 20 is defined so that the fluid flow rate of the system in operation can be controlled. This cross sectional area will be described hereinafter as the liquid outlet. This incorporates the fact that it has a specified diameter. That diameter need not match the diameter of line 10; rather, that diameter has a specific relationship with an gas line as will be described.

An air line 30 is also included. It connects from the top part of the tank, namely, the portion of the tank 22 where a gas head is accumulated, and it connects into the elbow 16. The air line 30 has a specified diameter. The ratio of the lines 20 and 30 is very important as will be described. The air line 30 is sufficiently high on the tank 22 that no water or other cleaning liquid is accumulated to that level. In other words, the line 30 delivers only gas out of the head space of the tank 22 but never delivers liquid. The purpose of the air line is to assure that the mixing gas is delivered into the cleaning liquid to froth the liquid.

The tank 22 is an upstanding cylindrical tank for storage of water or other liquid for cleaning purposes. At the bottom of the tank, there is a transverse partition 32 which breaks up the vortex otherwise formed while draining the tank. Several louvers 32 are included for this purpose. The tank has an inlet 34 at the upper end. The inlet 34 delivers a driving gas into the tank 22 through an orifice 36. The orifice has a sized opening diameter which regulates the flow into the tank. The fluid driving gas is delivered through a valve 40, the valve 40 being provided with motion from a valve operator 42. The valve is opened, closed or set to some intermediate position by the valve operator 42. The head space of the tank 22 is filled with gas, as mentioned, which is maintained at a specified pressure which pressure is sensed by a pressure transducer 44. A control system 48 is provided with the pressure of the tank 22 and provides a control signal to the valve operator 42. Typically, this can be a servo loop 46 which enables manipulation of the valve operator 42 so that the valve 40 is under control. The valve 40 connects through a line 48 to a storage tank 50. The connective line 48 delivers the driving gas from the tank 50 through the valve 40. The tank 50 serves as a reservoir of substantial size for the driving gas. The driving gas is delivered ratably and pressure peaks in the gas flow are avoided so that the slug flush is controlled.

METHOD OF FORMING A SLUG FLUSH

The method of the present disclosure is best illustrated by means of an example. Assume that the line 10 needs cleaning, and further assume that the equipment 12 has been connected to it. A specified volume of liquid is required for cleaning. In this instance, assume that the slug is to have a length in the line of approximately 20 diameters. Assume further that the density of the slug is to be 20% of the density of the liquid in the tank, and in this instance, the preferred liquid in the tank is water with trace additives such detergents to assist in frothing. Knowing the diameter of the line 10 and the requisite length of the slug, the total volume of liquid for the slug can be readily calculated. That volume of liquid is placed in the tank 22 using the sight glass 24 to measure this liquid. Observe further that the liquid accumulates in the tank 22 and the standpipe 20. Together, these form a U-tube. The accumulated liquid in the U-tube, having the desired volume, is openly connected to the line 10, but water can not be delivered into the line 10 until operation is started to force the water out of the tank 22.

Assume further that the lines 20 and 30 have a specified ratio. For instance, the line 20 can be four times larger in diameter than the line 30. In effect, this ratio can be achieved either by construction of the lines 20 and 30 with specified diameters, or alternatively, the lines 20 and 30 can be choked by placing orifices or valves in them. In either event, they are sized in the described manner so that the two lines deliver the water and the driving gas in a specified ratio. Initially, the head space in the tank 22 is maintained approximately at atmospheric pressure. Initially, the valve 40 is closed. The storage tank 50 is charged with the driving gas maintained at an elevated pressure. Assume for purposes for description that the tank 50 is pressurized to perhaps 200 psi.

To initiate operation, the valve 40 is simply opened and air from the tank 50 is delivered into the tank 22. Air flows through the airline 30 and mixes with the water from the standpipe 20 which is delivered from the tank 22. This mixing forms a froth slug having a substantially reduced average density. This dynamically formed slug has a density depending on the ratio of the respective air/water flows through the pipes 20 and 30.

At the time the valve 40 is first opened, the head space in the tank 22 is approximately at atmospheric pressure. The driving gas is delivered into the tank head space. The driving gas from the tank 50 is at an elevated pressure, for instance 2000 psi. Several scale factors control the rate of fast flow from the tank 50 into the tank 22. For instance, the diameter of the line 48, and the passage of the valve 40 control gas flow. In addition, the size of the orifice 36 controls the rate of flow. Suffice it to say, the head pressure level in the tank 22 is raised during a finite time interval. It is desirable that the pressure in the tank 50 be raised, but it is not raised instantly to create a pressure spike in the tank 22. Should the tank pressure jump too sharply, and dependent on scale factors, there is a great risk that the slug will not sufficiently froth and will therefore be too dense, will travel fast, and create substantial damage at an elbow or bend.

The control system 46 responds to the pressure in the tank 22 to deliver driving air into the tank. It is desirable that the pressure increase to some intermediate value and thereafter be sustained or increase more slowly. In actuality, there is less of pressure peak then a plateau which is first achieved and then held while the froth slug travels the full length of the line 10. As an example, assume that the line 10 opens to atmosphere so that the remote end of the line 10 is at zero psig. The slug, having a length of approximately 20 diameters as it travels down the line 10 in this illustration, typically needs a driving pressure behind it of about 8 to 12 psig to assure travel at adequate velocity. If the pressure at the backside of the slug were much greater, the velocity would become excessive and damage might result. Therefore, a representative driving pressure is about 8 to 12 psig behind the slug. Line drop on a very long line is only a few psi; the pressure at the back of the slug is therefore dependent on the pressure desired for the tank 22. In other words, the tank 22 is raised from zero psig to the range of about 12 to 16 psig and is gradually increased from that level substantially without spike or overrun. The tank 50 delivers driving air which pressurizes the tank 22 and flows into the line 10 to control the velocity of the slug. To achieve 50 feet per second velocity for the slug, additional air must be delivered into the tank 22 to fill approximately 50 feet of the line per second to continue the driving force behind the slug.

In contrast, completely opening the valve 40 almost instantly brings the tank 22 up to the elevated pressure of the supply tank 50 or 200 psi in this example. In that event, damage likely will be caused downstream by excessive slug density and/or excessive slug velocity int he line 10.

Alternate procedures in the practice of the present invention involve changing the diameters of the lines 20 and 30. One way is to change these lines, but greater convenience is achieved by placing orifices or valves in these lines which are selectively sized to assure selected controlled restriction to flow rates.

Other features which can be incorporated in the present procedure include the preliminary step of placing foaming agents in the water. This may change the froth of the water and the bubble size which is a key factor in the formation of the froth slug. Other solvents can also be used in this tank along with other detergents and the like. Equally important, water can be used or a hydrocarbon solvent (e.g. $CCL_4$, benzene, and others) can be used in place of water. This depends on the nature of the trash and debris in the line 10 to be removed by the slug flush.

While the foregoing is directed to the preferred embodiment of the apparatus and describes a method of operation, the scope thereof is determined by the claims which follow.

What is claimed is:

1. A method of slug flushing a pipe comprising the steps of:

(a) collecting a specified quantity of flushing liquid in a container wherein the container is connected by a liquid flow line to the pipe to be cleaned and is held in the liquid container until the slug flush is formed;

(b) through a gas flow line connected to the pipe to be cleaned, providing a controllable flow of slug flush gas for mixing with liquid to thereby define a froth slug flush;

(c) wherein proportioning of the slug flush liquid and gas is accomplished during delivery of the liquid and gas into the pipe to be cleaned;

(d) applying a driving gas behind the slug flush for forcing the slug flush through the pipe to be cleaned; and (e) controlling the pressure of the driving gas behind the slug flush to control slug flush velocity in the pipe within specified limits.

2. The method of claim 1 wherein the step of collecting flushing liquid in a container includes the preliminary step of filling that container to a specified level in the container, and thereafter emptying the container through the liquid flow line from the bottom of the container.

3. The method of claim 1 wherein the step of applying a flow of slug flush gas includes the steps of:

(a) filling a gas storage container to a specified pressure holding a specified volume of compressed gas;

(b) connecting a line from the gas storage container to the container holding the flushing liquid therein;

(c) controlling gas flow through said line by operation of a valve; and (d) controllably opening said valve to control the rate at which gas is admitted to the container with the flushing liquid.

4. The method of claim 3 including the step of monitoring pressure in the liquid container after opening said valve.

5. The method of claim 4 including the step of opening said valve dependent on the monitored pressure in the liquid container.

6. The method of claim 1 including the preliminary steps of connecting said liquid flow line serially with an orifice of specified size to control liquid flow therethrough, and connecting said gas flow line with a specified size to control gas flow therethrough.

7. The method of claim 6 including the step of driving liquid from said liquid container by opening said valve to admit gas to said container.

8. The method of claim 1 wherein the step of controlling the pressure of the driving gas includes the preliminary steps of:

(a) providing a driving gas in a pressurized container;

(b) connecting said pressurized container to provide the driving gas through a drive gas line;

(c) controlling flow through said drive gas line by a control valve;

(d) wherein said control valve has a fully open position, a fully closed position, and intermediate positions providing intermediate flow; and (e) controllably opening said valve while measuring pressure in said liquid container so that pressure does not rise above specified limits while forcing the slug flush through the pipe to be cleaned.

9. The method of claim 8 including the step of mixing liquid and gas on discharge into the pipe to be cleaned.

10. An apparatus for slug flushing a pipe connected thereto comprising:

(a) flushing liquid container means for receiving a specified liquid quantity therein for formation of a slug flush;

(b) a liquid flow connected from said container means and adapted to be connected to the pipe to be cleaned wherein the liquid flow line connects near the bottom portions of said container means to remove substantially all the liquid therein by flow through said liquid flow line;

(c) a gas flow line connected from said container means and adapted to be connected with the pipe to be cleaned wherein said gas flow line opens into said container means above liquid therein; and (d) means for controllably introducing a driving gas into said container means at a controllable gas flow rate.

11. The apparatus of claim 10 further including a valve means operated by a valve operator, and also valve servo means for control of gas flow into said container means.

12. The apparatus of claim 10 including pressure sensor means connected to said container means to measure pressure therein.

13. The apparatus of claim 12 including servo means connected to said pressure sensor means to be operated thereby and control opening of valve means admitting gas to said container means.

* * * * *